United States Patent [19]

Simonson

[11] 4,412,703

[45] Nov. 1, 1983

[54] DRAWER SLIDE SYSTEM

[76] Inventor: Jorgen R. Simonson, 8441 Millbridge Cir., Huntington Beach, Calif. 92646

[21] Appl. No.: 329,394

[22] Filed: Dec. 10, 1981

[51] Int. Cl.[3] ..... F16C 21/00

[52] U.S. Cl. ..... 308/3.6; 308/3.8; 312/330 R; 312/341 R

[58] Field of Search ..... 308/3.6, 3.8, 3 A, 3 R; 312/330 R, 346, 347, 341, 342, 349

[56] References Cited

U.S. PATENT DOCUMENTS

| | | | |
|---|---|---|---|
| 2,255,290 | 9/1941 | Kennedy | 308/3.8 X |
| 2,587,691 | 3/1952 | Brewer | 312/350 X |
| 3,119,644 | 1/1964 | Workman | 312/346 |
| 4,037,897 | 7/1977 | Siggia | 308/3.6 X |
| 4,061,375 | 12/1977 | Mertes | 308/3.6 |
| 4,125,297 | 11/1978 | Mertes | 308/3.6 |

*Primary Examiner*—Stuart S. Levy
*Assistant Examiner*—Thomas R. Hannon
*Attorney, Agent, or Firm*—Willie Krawitz

[57] ABSTRACT

An injection molded plastic drawer slide and track are provided having a T-shaped drawer support portion and two separate, thick slide members that interfit with a corresponding shaped slide track. The thickness of the slide members improves stiffness and slide properties, and the use of a rugged guide rail permits a heavier load to be carried with less friction. The drawer slide and track are configured to resist permanent deformation under a long term, stationary load.

A simple roller bearing means for the drawer and end locking members for the slide track are also provided.

9 Claims, 11 Drawing Figures

60
61
62
63
64
65
66
67
68
69
70
71
72
73
39
40
41
42
10
11
26
26A
27
27A
28
45
46
47
48
49
50
51
52
53
54
54A
55
56
57

DRAWER SLIDE SYSTEM

BACKGROUND OF THE INVENTION

This invention relates to a new and improved drawer slide system produced from injection molded plastic components. The drawer slide has a sturdy construction, an easier sliding action than similar devices, and has good resistance to warping forces of the wooden cupboards.

Various publications have disclosed drawer slide systems, and these include U.S. Pat. Nos. 4,061,375; 4,125,297; and, 4,236,773. Basically, the three patents disclose a channel-ride system for drawers, and also drawer rollers that support the drawers with a rolling surface.

The problem associated with the design of these slide systems is that contact is made only between relatively small areas of the track and slide runners. Consequently, when the drawer is opened, the levering action due to the drawer weight will distort the track and the slide runners. Another problem is caused by the possibility of a permanent set being produced in plastic parts by a long term, stationary, heavy load which in this case would occur if a heavily loaded drawer is used only infrequently.

A slide runner and track system for a drawer is desired that ill resist stress due to levering action and load deformation of the drawer and at the same time will provide smooth drawer movement. In addition, a simplified roller support is desired for the drawer. Also, a slide runner and track are desired that will resist warping of wooden parts in the drawer.

THE INVENTION

According to the invention, a slide runner and slide track for a drawer is disclosed, providing a slide track defining a bottom channel with inwardly U-shaped side and upper members. The slide runner provides a T-shaped drawer support having two aligned runners mounted under the support, and each slide member is positioned at opposite ends of the slide and about midway between opposite sides of the T-shape.

Each slide at its underside has a generally I-shaped configuration that is shaped to conform with the bottom channel of the track, and the drawer support at its underside is supported by the upper members of the slide track. Hence, a stable movement of the slide support is provided.

Furthermore, any levering action due to the weight of the drawer (and contents) when extended, will be applied to a much thicker mass of material in the slide member. Since deflection is proportional to thickness$^3$ and an I-shaped beam through its central axis, a much stiffer slide member is provided on a weight-for-weight basis compared to, say a channel beam where the pressure is transverse to the central axis, and the material in the channel beam is much thinner since it is distributed over the entire length of the slide.

DESCRIPTION OF THE PREFERRED EMBODIMENTS

Figure 1:
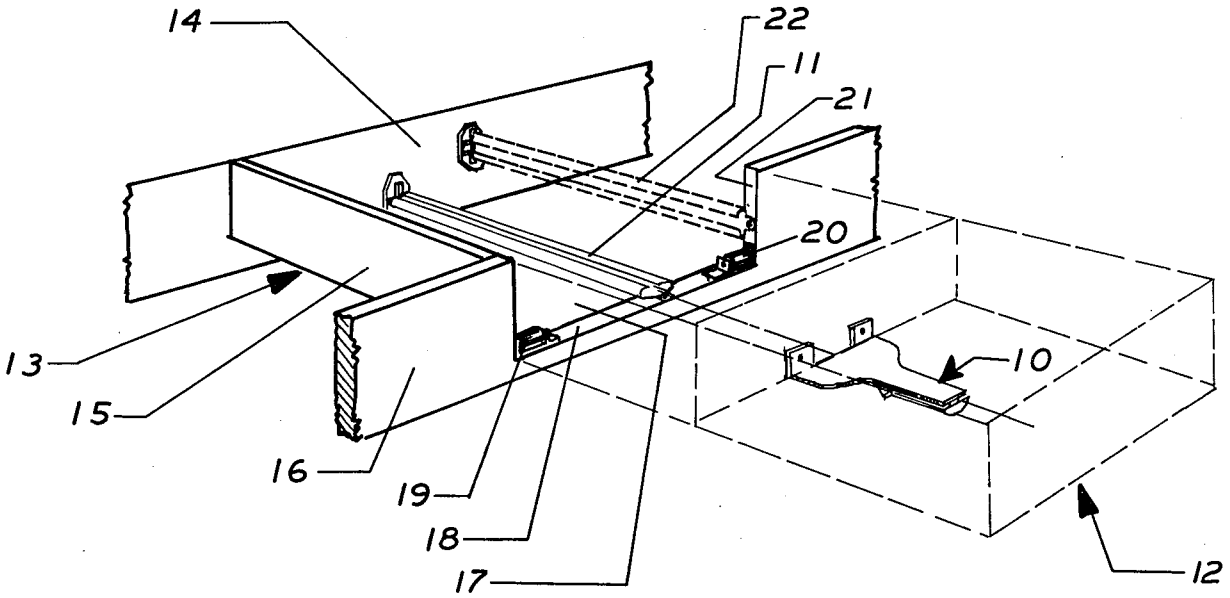
FIG. 1 is an upper perspective view illustrating the drawer slide runner of this invention and a slide track installed for movement of a drawer therealong.

The slide runner 10 and slide track 11 of this invention for a drawer 12 in a cabinet 13 is shown in FIG. 1. The cabinet 13 may include back, side and front portions 14, 15 and 16 respectively, and an opening 17 is provided in the front portion 16 through which the drawer moves. A bottom ledge 18 in the opening 17 provides a support for rollers 19, 20 and the slide track 11. When the bottom ledge 18 is omitted, a side ledge 21 may be employed. The side ledge 21 may be used as a support for a slide track (dotted designation) 22 in addition to, or as an alternative for, slide track 11. The slide tracks 11 and 22 are preferably identical to reduce the number of required components.

Figures 2, 2A, 3, 3A:
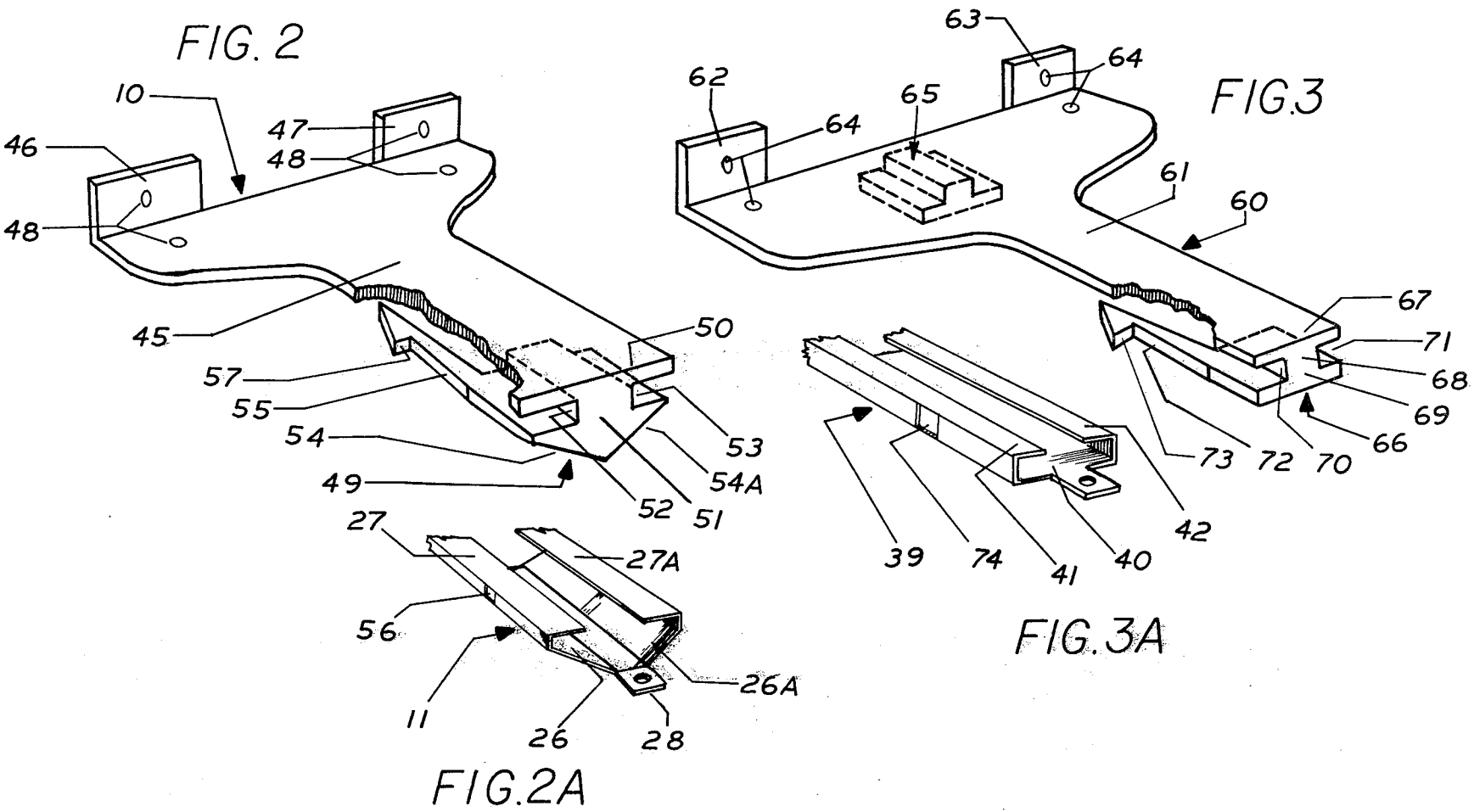
FIGS. 2 and 2A, 3 and 3A are upper perspective views of two slide runners having differently shaped track guides and their respective corresponding slide tracks.

One form of the slide track 11 is shown in FIG. 1, and two embodiments are also shown in greater detail in FIGS. 2A and 3A. The embodiment of FIG. 2A includes a V-shaped metal channel portion 26, **26*a* and inwardly folded channel guide rail members 27, 27*a*. A forward extension 28 is perforated to receive a screw for attachment to the bottom ledge 18 or the side ledge 21**.

Figure 6:
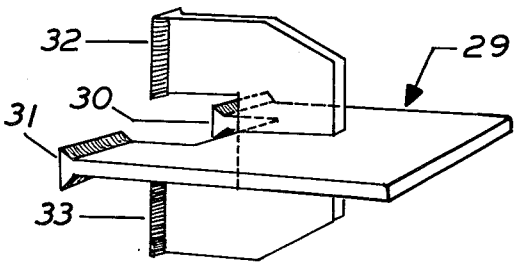
Figure 7:
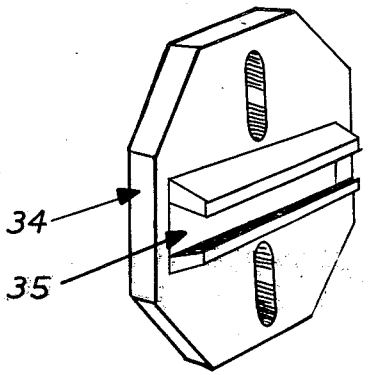

As shown in FIGS. 1 and 6, the ends of tracks 11 and 22 are provided with an end element 29 having fitting members 30, 31, 32 and 33. The end element 29 is inserted into the end of the tracks 11 or 22. An end piece 34 defines a channel 35 that engages the fitting members 30 and 31 in channel 35 if the slide track is supported on ledge 18. Alternatively, the fitting members 32, 33 engage channel 35 if the slide track is supported on ledge 21. Hence, only two fitting members are used simultaneously in the end piece. Since the end piece 34 and fitting members are symmetrically shaped, this reduces the number of components necessary for an assembly.

Slide track 39 in FIG. 3A utilizes a metal flat channel 40 configuration, and guide rails 41, 42 that are rectangularly shaped. This form of track is an alternative to the V-shaped track 11 in FIG. 2A, which is initially less expensive to manufacture.

Figure 4:
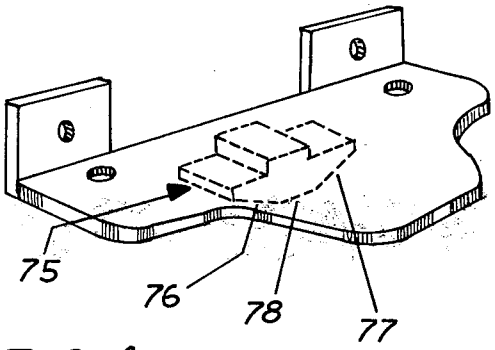
FIG. 4 is an upper perspective view of a slide runner showing another shape of a track runner.

Various slide runner embodiments are shown in FIGS. 2, 3 and 4. FIG. 2 illustrates the slide runner 10 shown in FIG. 1, and includes a flat, T-shaped drawer support portion 45, with upstanding flanges 46, 47 at the rear edge of the support. Holes 48 in the tabs and support portion 45 enable attachment by screws to the drawer at the rear and underside. A front track runner element 49 is integrally formed forwardly and below the support portion 45, and defines an I-beam cross section shape formed by the leading edge 50 of the support portion 45, the central element 51 of the I-beam and channel members 52 and 53. These channels form a sliding contact with the channel guide rails 27, **27*a*. The lower portion of the track runner element 49 includes V-shaped runners 54, 54*a*. These two runners do not contact the sides 26, 26*a* of the track, and this reduces friction. A flexible lock rod 55 is inwardly biased and will move outwardly to engage a slot 56 in the track by its hook 57 when the drawer is extended fully. When locked in position, the lock rod 55 may be disengaged from the track by depressing the hook 57 out of the slot 56. A similarly shaped rear track runner element (not shown) is integrally formed rearwardly of the slide runner 10, and is axially aligned with the front track runner 49**.

Typically, the central element 51 of the I-beam varies from about ½" to ¾", each runner 54, 54*a* has a length of about ⅜" to ¾", the width of the slide at the leading edge 50, transversely of the central beam 51 varies from about ¾" to 1¼" and the runner depth varies from about 1½" to 2". These dimensions are applicable for injection molded materials such as high density polyethylene, nylon, etc. As indicated, since stiffness is proportional to depth$^3$, when the material of each track runner is concentrated into two separate elements forwardly and rearwardly of the slide runner, rather than using a continuously formed, thin track runner, stiffness characteristics are greatly improved. This is particularly important if the drawer and its contents are heavy, and the weight is levered against the slide system when the drawer is opened wide. Also, the stiffness capability enables the slide runner to better resist unbalanced loads such as off-centered or skew types, and impact loads.

FIG. 3 illustrates an alternative embodiment of a slide runner 60 which has a lighter construction compared to that shown in FIG. 2. The slide runner defines a flat, T-shaped drawer support 61 having upstanding flanges 62, 63 rearwardly of the drawer support. Holes 64 in the drawer support enable the slide runner to be attached by screws to the drawer at its underside and rear, similarly as shown in FIG. 1. Front and rear track runners 65, 66 are integrally molded to the slide runner and are axially aligned with each other about midway between the sides of the drawer support. The front edge 67 of the slide support and the front track runner 66 are I-shaped and include a central beam 68, a lower edge 69, and rectangular channels 70, 71 which form a close interfit with the guide rails 41, 42 of the slide track 39 embodiment shown in FIG. 3A. A flexible lock rod 72 having a hook 73 is adapted to engage a slot 74 in the slide track 39 to prevent the drawer from becoming overextended in the slide track. It will be appreciated that it is not essential to provide a lock rod for the track runner to engage the slide track. Such an arrangement would be less expensive, but somewhat more hazardous, compared to using a lock rod.

Another embodiment of a track runner 75 having a different configuration is shown in FIG. 4. The track runner has V-shaped sides 76, 77 and a flat bottom 78.

Figure 5C:
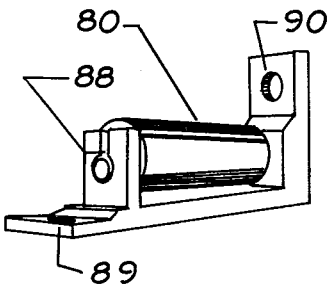
FIGS. 5A, 5B and 5C are views in end elevation, side elevation and side perspective views respectively of a support roller for the drawer; and, FIGS. 6 and 7 are views in side perspective showing end fittings for the slide track.
Figure 5B:
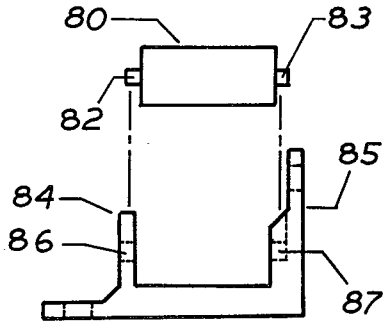
Figure 5A:
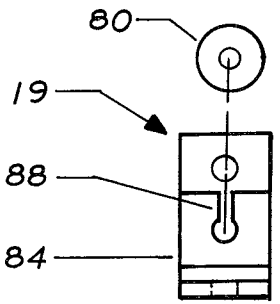

Drawer bearing rollers 19, 20 in FIG. 1 are shown in greater detail in FIGS. 5A, 5B and 5C. They may be made of injection molded materials similar to the slide runners, and these materials provide good stiffness and wear properties at low cost. Each bearing roller includes a roller portion 80 having end support pins 82, 83. A roller support 19 with upstanding elements 84, 85 provides journal supports 86, 87 for the support pins. The journal supports 86, 87 are slotted 88 to allow the support pins 82, 83 to be fitted easily into them. The roller support is mounted in the bottom ledge 18 of the cabinet opening 17 by means of a screw through a hole 89, 90.

The configuration of the track runners of this invention enables a good contact to be made with the track both above and below the upper members, and this provides a smooth and stable ride. Use of dual track runners provides a good stiffness to weight ratio, and this resists leverage action by the drawer. Furthermore, the track runners also reinforce the support at each end, and this reduces the tendency of the slide to undergo a permanent plastic set or deformation under a long term, stationary load.

Obvious equivalents of this invention may be practiced without departing from the spirit thereof. For example, additional track runners may be employed if a very long slide runner is used. Also, the track runners need not be integrally formed, but may be separately attached to the slide runners; this would be initially cheaper in terms of tooling costs, but would be ultimately more expensive in terms of production costs. In addition, the end element 29 could employ a solid fitting member instead of fitting members 30, 31 and the fitting members could be reversed with respect to the end element.

I claim:

1. A slide and interfitting track system for a drawer, and the like, manufactured from an injection molded plastic material, comprising:

A.

i a generally T-shaped, flat drawer support portion defining leading and trailing edges;

ii. at least one flange rearwardly of the support and integral with the trailing edge;

iii. means for attaching the flange and support portion to the drawer;

iv. forward and rear longitudinally aligned slide runners disposed centrally under the support and integral therewith at the leading and trailing edges, respectively, each slide runner and support edge defining an I-beam shaped cross section, including a channel portion defined on each side of the runner when viewed longitudinally along the slide runner;

B. a slide track defining a bottom portion and generally U-shaped, inwardly folded rail members adapted to interfit with the slide runners for movement therealong; and, C. end mountings provided for the track, comprising an end piece insertable into the slide track, the end piece including a first and second set of spaced apart twin members, each set of members being oriented at right angles to each other, and an interfitting base member for the end piece mounted centrally under the drawer, the base member defining a horizontal channel adapted to interlock with a set of twin members of the end piece.

2. The slide track of claim 1, in which the horizontal channel of the base member is adapted to be oriented vertically or horizontally.

3. The slide and track system of claim 1, in which the injection molded plastic is selected from the class consisting of nylon and high density polyethylene.

4. The slide and track system of claim 1, in which the I-beam along its central axis varies from about ½" to ¾", each runner has a length of about ⅜" to ¾", the width of the slide at the leading edge, transversely of the central beam varies from about ¾" to 1½", and the runner depth varies from about 1½" to 2".

5. The slide and track system of claim 1, in which the slide includes an inwardly biased member adapted to move outwardly and engage the track near its forward end.

6. The slide and track system of claim 1, in which the slide runners are V-shaped with respect to the I-beam along its central axis.

7. The slide and track system of claim 1, in which the slide runners are flat with respect to the I-beam at its base.

8. The slide and track system of claim 1, in which the slide track is fixed.

9. The slide and track system of claim 1, in which roller support means for the drawer are mounted on either side of the slide track, the roller means comprising a roller support including spaced apart upstanding elements providing journal supports, and a roller bearing having end support pins adapted for mounting within the journal supports.

* * * * *